US005435707A

United States Patent [19]

Hirano et al.

[11] Patent Number: 5,435,707

[45] Date of Patent: Jul. 25, 1995

[54] SCROLL-TYPE COMPRESSOR WITH AN ELASTICALLY DEFORMABLE TOP PLATE OR END PLATE

[75] Inventors: Takahisa Hirano; Masumi Sekita; Makoto Fujitani, all of Nagoya, Japan

[73] Assignee: Mitsubishi Jukogyo Kabushiki Kaisha, Tokyo, Japan

[21] Appl. No.: 261,122

[22] Filed: Jun. 14, 1994

[30] Foreign Application Priority Data

Jun. 14, 1993 [JP] Japan ..... 5-141946

[51] Int. Cl.[6] ..... F01C 1/04

[52] U.S. Cl. ..... 418/55.5; 418/55.2; 418/57

[58] Field of Search ..... 418/55.2, 55.7, 57

[56] References Cited

U.S. PATENT DOCUMENTS 4,767,293 8/1988 Caillat et al. ..... 418/55
5,192,202 3/1993 Lee ..... 418/55.5
5,257,920 11/1993 Takeda ..... 418/55.5

FOREIGN PATENT DOCUMENTS 62-141688 9/1987 Japan .

*Primary Examiner*—Richard A. Bertsch
*Assistant Examiner*—Charles G. Freay
*Attorney, Agent, or Firm*—Birch, Stewart, Kolasch and Birch

[57] ABSTRACT

A scroll-type compressor having a fixed scroll and a revolving scroll, wherein a portion of either the end plate of the fixed scroll or the top plate above the fixed scroll has annular grooves formed therein, allowing elastic deformation of either the end plate or the top plate in a thrust direction, thus preventing gaps between the spiral wraps of both scrolls.

6 Claims, 5 Drawing Sheets

SCROLL-TYPE COMPRESSOR WITH AN ELASTICALLY DEFORMABLE TOP PLATE OR END PLATE

FIELD OF THE INVENTION AND RELATED ART STATEMENT

The present invention relates to a scroll-type compressor used for refrigeration, air conditioning, etc.

FIG. 4 is a longitudinal sectional view of a conventional scroll-type compressor. Referring to this figure, in a closed housing 8, a scroll-type compression mechanism C is disposed at the upper part, while an electric motor M at the lower part. The scroll-type compression mechanism C comprises a fixed scroll 1, an revolving scroll 2, a rotation checking mechanism 3 such as Oldham's ring, which allows the revolving motion of the revolving scroll 2 but checks the rotation thereof, a frame 6 to which the fixed scroll 1 and the electric motor M are fastened, a plurality of bolts 18 for fastening the fixed scroll 1 to the frame 6, an upper bearing 71 and a lower bearing 72, which pivotally support a rotating shaft 5, an orbiting bearing 73 for supporting the revolving scroll 2, and a thrust bearing 74.

The fixed scroll 1 has an end plate 11 and a spiral wrap 12 disposed on the inner surface of the end plate 11. The end plate 11 is provided with a discharge port 13 and a discharge valve 17 for opening/closing the discharge port 13. The revolving scroll 2 has an end plate 21 and a spiral wrap 22 disposed on the inner surface of the end plate 21. In a boss 23 disposed on the outer surface of the end plate 21, a drive bush 25 is rotatably fitted via the orbiting bearing 73. An eccentric pin 53 extending from the upper end of the rotating shaft 5 is rotatably fitted to an eccentric hole made in the drive bush 25. The drive bush 25 is provided with a balance weight 84.

The fixed scroll 1 and the revolving scroll 2 are off-centered by the revolution radius and engaged with each other at a shifted angle of 180 degrees, so that a plurality of enclosed spaces 24 are formed symmetrically with respect to one point.

In such a construction, the revolving scroll 2 is driven by driving the electric motor M via the rotating shaft 5, the eccentric pin 53, the drive bush 25, and the boss 23. The revolving scroll 2 revolves on an orbit with the revolution radius while its rotation being checked by the rotation checking mechanism 3. Thereby, gas enters the housing 8 through a suction pipe 82. After cooling the electric motor M, the air passes through a passage 85 formed in the frame 6, and is sucked from the suction passage 15 in the fixed scroll 1 into the enclosed space 24 through a suction chamber 16. The gas in the enclosed space 24 reaches the central portion while being compressed as the volume of the enclosed space 24 is decreased by the revolving motion of the revolving scroll 2, and then enters a discharge cavity 14 through the discharge port 13 by pushing the discharge valve to open, being discharged to the outside through a discharge pipe 83.

During the rotation of the rotating shaft 5, lubricating oil 81 stored at the inner bottom of the housing 8 is sucked by a centrifugal pump 51 installed at the lower part of the rotating shaft 5. The sucked oil passes through an oil supply hole 52, and lubricates the lower bearing 72, the eccentric pin 53, the upper bearing 71, the rotation checking mechanism 3, the orbiting bearing 73, the thrust bearing 74, etc. Then, the lubricating oil is discharged through a chamber 61 and an oil discharge hole 62, and stored at the bottom of the closed housing 8.

FIG. 5 schematically shows the distribution of the pressure acting on the end plate of the fixed scroll 1 and the deformation thereof, whereas FIG. 6 schematically shows the distribution of the pressure acting on the end plate of the revolving scroll 2 and the deformation thereof. The pressure produced in the enclosed space 24 formed between the fixed scroll 1 and the revolving scroll 2 provides high pressure HP at the central portion, intermediate pressure MP at a portion slightly apart from the central portion, and low pressure LP near the outer periphery. The figures are drawn assuming LP=0. These pressures deform the end plates 11 and 21 of the fixed scroll 1 and the revolving scroll 2, respectively, as indicated by the alternate long and short dash line. In other words, the two end plates 11 and 21 are deformed in such a direction that they part from one another. In the conventional scroll-type compressor, therefore, a gap is produced between the tip end of the spiral wrap 12, 22 of the scroll 1, 2 and the end plate 21, 11 of the mating scroll 2, 1, so that gas leaks from this gap, resulting in deteriorated performance of the compressor.

Further, in the scroll-type compressor of this type, the revolving scroll 2 performs an inclined motion with an inclination angle of about 1 to $20\times10^{-3}$ rad due to the pressure acting in the direction perpendicular to the spiral wrap. However, a flange portion 19 (FIGS. 4 and 5) of the fixed scroll 1 is not deformed because the flange portion 19 has high rigidity, and only the end plate 11 of the fixed scroll 1 is deformed as described above. Therefore, the inclined motion of the revolving scroll 2 produces a small gap in the radial direction between the spiral wraps 12 and 22 of the scrolls 1 and 2, which causes deteriorated performance of the compressor.

OBJECT AND SUMMARY OF THE INVENTION

An object of the present invention is to provide a high-performance scroll-type compressor which eliminates the disadvantages of the prior art, and prevents the formation of a gap in the radial direction between the spiral wraps and a gap between the spiral wrap and the end plate of the mating scroll.

The scroll-type compressor of the present invention solves the above problems and has the following features: (1) In a scroll-type compressor which has paired fixed scroll and revolving scroll, each of which consists of a spiral wrap and an end plate, and is constructed so that the fixed scroll is fixed by a flange portion of the end plate thereof, a portion which allows elastic deformation in the thrust direction is provided at the flange portion of the end plate of the fixed scroll. (2) In a scroll-type compressor which has paired fixed scroll and revolving scroll, each of which consists of a spiral wrap and an end plate, and is constructed so that the fixed scroll is fixed to a top plate, a portion which allows elastic deformation in the thrust direction is provided at the peripheral portion of the top plate. (3) In a scroll-type compressor defined in the above item (1) or (2), a pressure adding chamber for displacing the fixing scroll toward the revolving scroll is provided on the back side of the fixed scroll or the top plate.

In the invention of the above item (1), since a portion which allows elastic deformation in the thrust direction is provided at the flange portion of the end plate of fixed scroll, the fixed scroll can be inclined as a whole and follow the inclined motion of the revolving scroll, so that the formation of a gap in the radial direction, that is, a gap between the spiral wraps of both scrolls can be prevented.

In the invention of the above item (2), since a portion which allows elastic deformation in the thrust direction is provided at the peripheral portion of the top plate, the top plate can be inclined, and accordingly the fixed scroll fixed to the top plate can be inclined, so that the fixed scroll follows the inclined motion of the revolving scroll, which prevents the formation of a gap in the radial direction like the case of the above item (1).

In the invention of the above item (3), since the end plate of the fixed scroll can be pushed toward the revolving scroll in addition to the features of the above items (1) and (2), the formation of a gap between the tip end of the spiral wrap and the end plate of the mating scroll can be prevented in addition to the aforementioned operations.

DETAILED DESCRIPTION OF PREFERRED EMBODIMENTS

Figure 1:
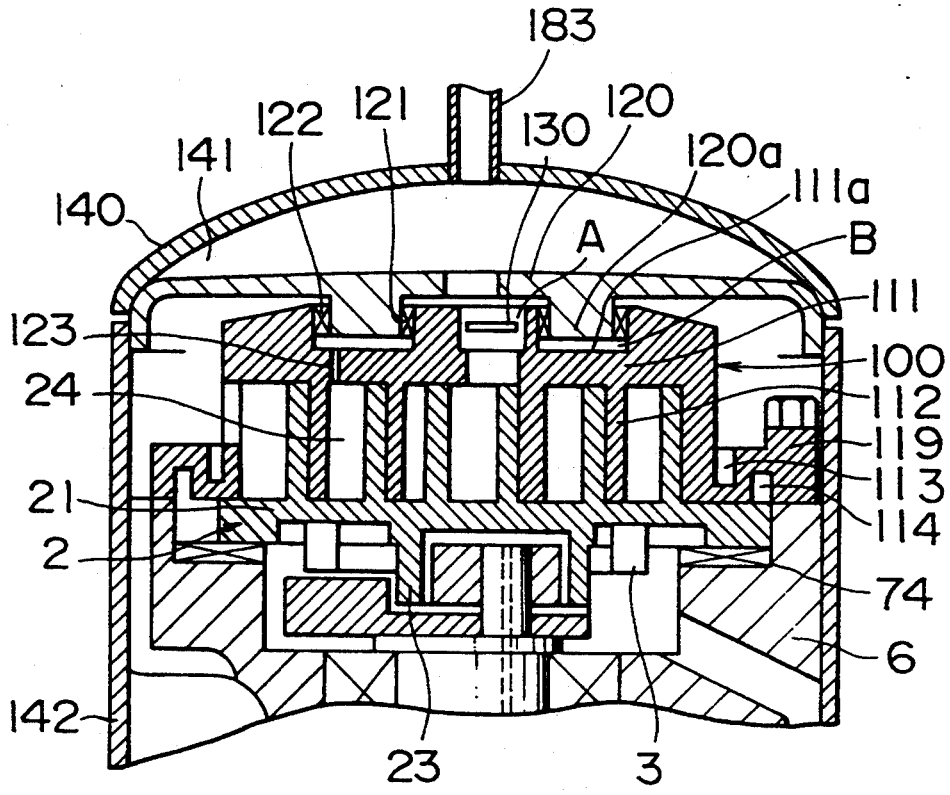
FIG. 1 is a partly longitudinal sectional view of a scroll-type compressor according to a first embodiment of the present invention.

FIG. 1 is a partly longitudinal sectional view of a scroll-type compressor according to a first embodiment of the present invention. In this figure, reference numeral 142 denotes an intermediate housing, 6 denotes a frame, 2 denotes an revolving scroll, 100 denotes a fixed scroll which engages with the revolving scroll 2 and is fixed to the frame 6, 120 denotes a top plate covering the fixed scroll 100, and 140 denotes an upper housing installed above the top plate 120. The fixed scroll 100 differs in shape from the conventional one. Reference numeral 119 denotes a flange of the fixed scroll 100, and reference numerals 113 and 114 denote annular grooves formed on the opposite surfaces of the flange 119. Owing to these grooves, the flange 119 can be elastically deformed in the axial direction of the compressor. Reference numeral 111 denotes an end plate of the fixed scroll 100. A back pressure chamber A for applying a high pressure is provided at the central portion on the side opposite to a spiral wrap 112 of the end plate 111. A back pressure chamber B for applying a pressure during compression in an enclosed space is provided annularly surrounding the back pressure chamber A. The top plate 120 is provided with an annular convex portion 120*a*, which is inserted into a concave portion 111*a* of the end plate 111. By interposing seal members 121 and 122 between the convex portion 120*a* and the concave portion 111*a*, the aforementioned back pressure chamber B is formed. A pressure introducing hole 123 introduces the pressure of gas under compression from the enclosed space 24 to the back pressure chamber B thus formed. Reference numeral 130 denotes a discharge valve installed in the aforementioned back pressure chamber A, 141 denotes a discharge chamber formed between the top plate 120 and the upper housing 140, and 183 denotes a discharge pipe. The intermediate housing 142, the top plate 120, and the upper housing 140 are welded to each other. Since the elements other than those described above are the same as the elements of the prior art, the description of the elements is omitted.

Figure 2A:
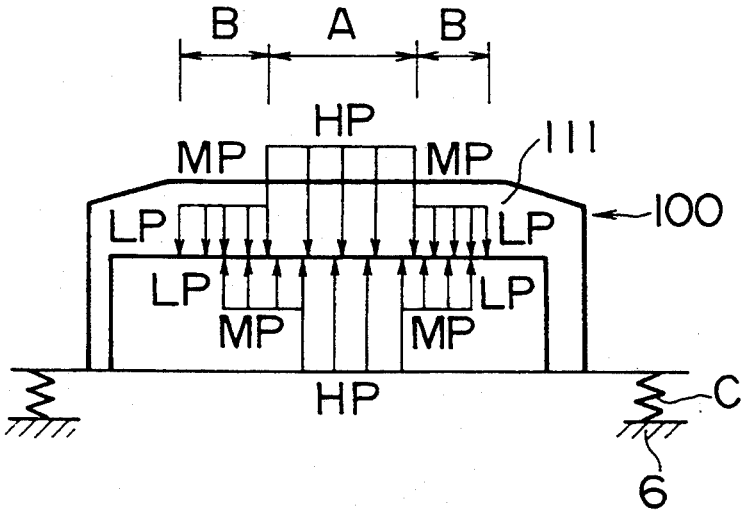
FIGS. 2(*a*) and 2(*b*) are views illustrating the distribution of pressure acting on the end plate of the scroll in the above embodiment and the deformation and displacement thereof.
Figure 2B:
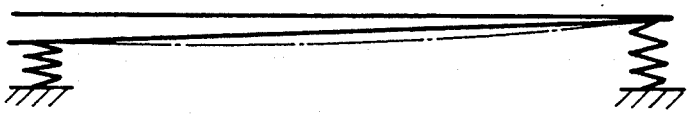
Figure 5:
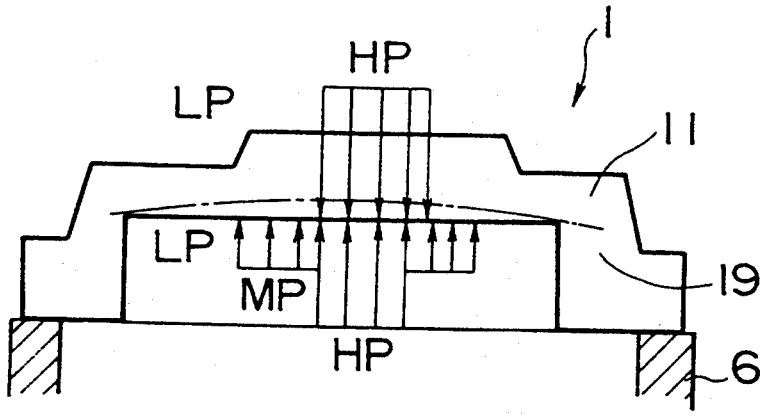
FIG. 5 PRIOR ART
FIG. 5 is a view illustrating the distribution of pressure acting on the end plate of the conventional fixed scroll and the deformation thereof.
Figure 6:
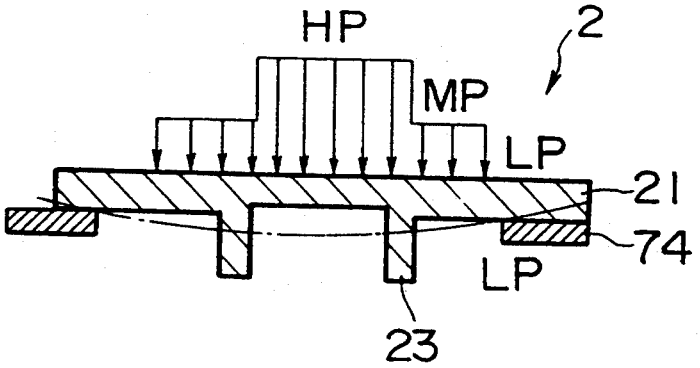
FIG. 6 PRIOR ART
FIG. 6 is a view illustrating the distribution of pressure acting on the end plate of the conventional revolving scroll and the deformation thereof.

FIG. 2 schematically shows the distribution of the pressure acting on the end plate of the fixed scroll 100 and the deformation and displacement thereof, corresponding to FIG. 5. In FIG. 2(*a*), high pressure HP, intermediate pressure MP, and low pressure LP are applied to the end plate 111 of the fixed scroll 100 from the enclosed space 24 side. This figure is drawn assuming low pressure LP=0. The back pressure chambers A and B are subjected to high pressure HP, intermediate pressure MP, and low pressure LP, respectively. By properly setting the area and position of the back pressure chambers A and B, the pressure on the back pressure chamber side can be slightly higher than the pressure on the enclosed space 24 side. In this case, the end plate 111 of the fixed scroll 100 is deformed slightly in the convex form toward the enclosed space 24 side, inversely as compared with the prior art, as indicated by the alternate long and short dash line in FIG. 2(*b*).

Since the flange 119 of the fixed scroll 100 is provided with the grooves 113 and 114 to allow the flange 119 to be deformed elastically, the fixed scroll 100 is in such a condition as to be supported to the frame 6 with a kind of spring C. Therefore, the fixed scroll 100 is slightly displaced toward the revolving scroll 2 because the pressure on the back pressure chamber A, B side is higher than the pressure on the enclosed space 24 side. This displacement follows not only the pressure distribution but also the inclination of the revolving scroll 2.

The above-mentioned operation prevents the formation of a gap between the tip end of spiral wrap of each scroll and the end plate of the mating scroll, which has been caused conventionally by the deformation due to pressure, and the formation of a gap in the radial direction of both scrolls caused by the inclined motion of the revolving scroll. For this reason, the scroll-type compressor of this embodiment achieves high performance.

Figure 3:
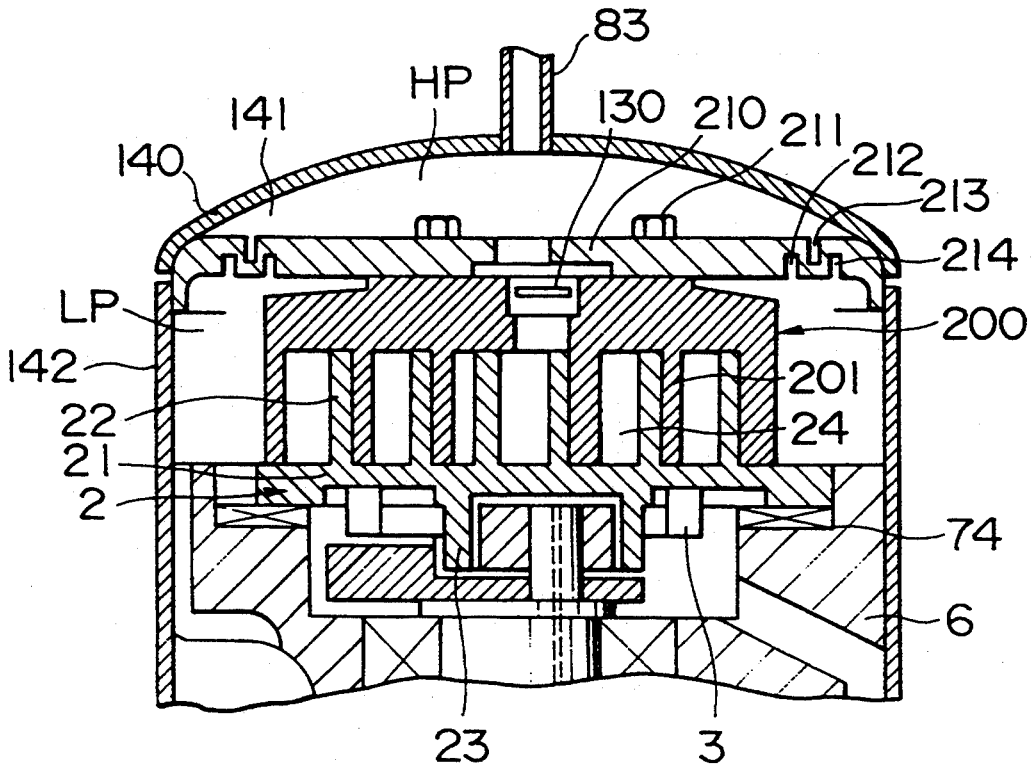
FIG. 3 is a partly longitudinal sectional view of a scroll-type compressor according to a second embodiment of the present invention.
Figure 4:
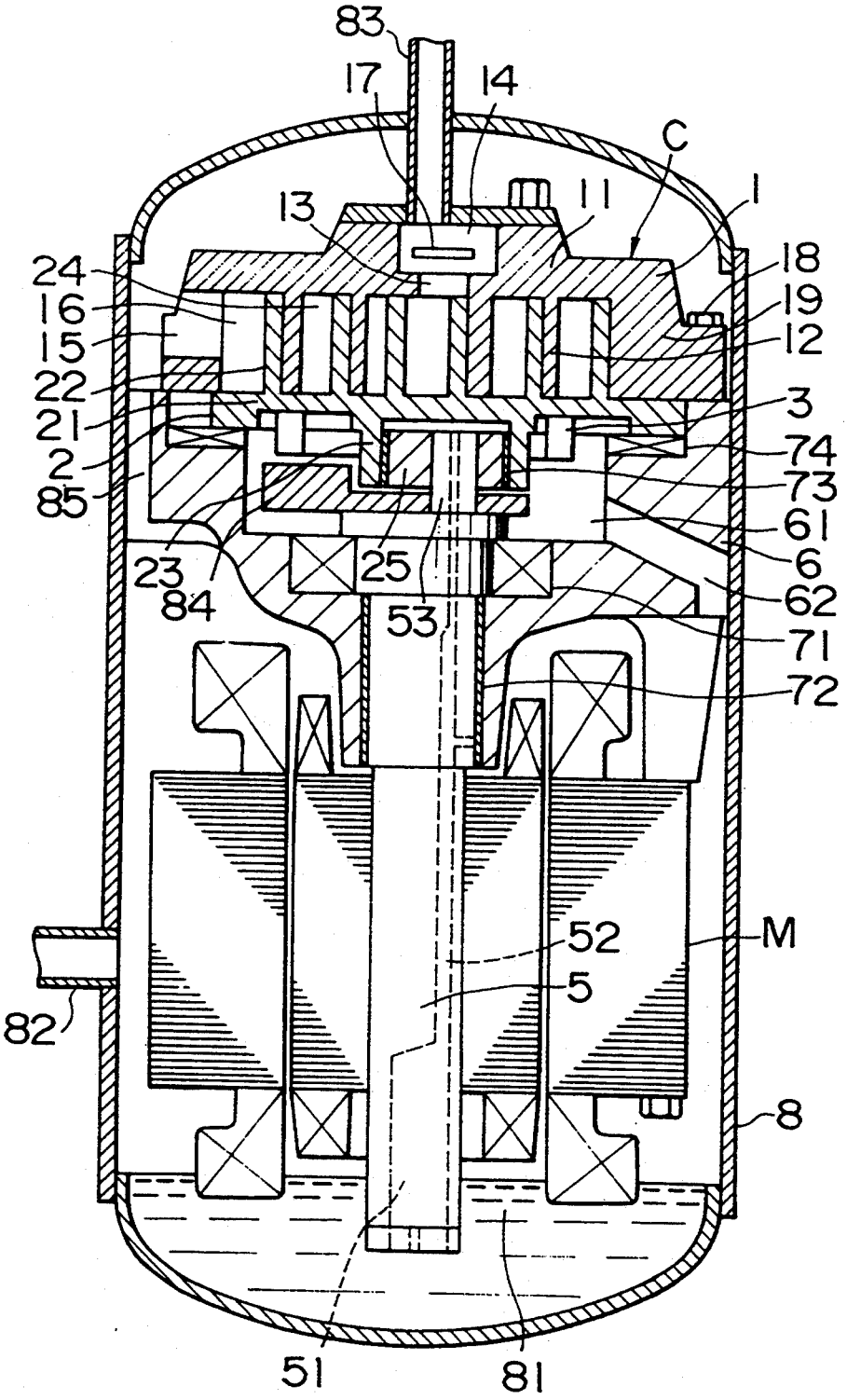
FIG. 4 PRIOR ART
FIG. 4 is a longitudinal sectional view of a conventional scroll-type compressor.

FIG. 3 is a partly longitudinal sectional view of a scroll-type compressor according to a second embodiment of the present invention. In this figure, reference numeral 200 denotes a fixed scroll, 210 denotes a top plate which is in contact with the fixed scroll 200, and 211 denotes a bolt fastening the top plate 210 to the fixed scroll 200 at the area near the central portion. Annular grooves 212, 213, and 214 are provided alternately on the opposite side of the surface of the top plate 210 at its peripheral portion. In this embodiment, the flange, the grooves in the flange, and the back pressure chamber B formed on the end plate, which are provided in the first embodiment, are not provided. The fixed scroll 200 is supported by the top plate 210 only, and is not fixed to the frame 6. The elements other than those described above are the same as the elements of the first embodiment.

When the compressor is in operation, the discharge chamber 141 is subjected to high pressure HP of the compressor, so that the central portion of the top plate 210 and the fixed scroll 200, which is integrally connected to the top plate 210, are slightly displaced downward by the pressure load relationship between the low pressure on the lower surface of the peripheral portion of the top plate 210 and the pressure of the enclosed space 24. The fixed scroll 200 is deformed because its area near the central portion is pushed by the top plate 210 and follows the revolving scroll 2 which accomplishes inclined motion. This prevents the formation of a gap at the tip end of the spiral wrap 22, 201 of the scroll 2, 200 and the formation of a radial gap between the spiral wraps 22 and 201 caused by the inclined motion of the revolving scroll 2, achieving high performance of the scroll-type compressor of this embodiment.

In the scroll-type compressor of the present invention, a portion which allows elastic deformation in the thrust direction at the flange portion of the end plate of the fixed scroll is provided, or a portion which allows elastic deformation in the thrust direction at the peripheral portion of the top plate is provided for the configuration in which the fixed scroll is fixed to the top plate. Therefore, the fixed scroll can be inclined and follow the inclined motion of the revolving scroll, so that the formation of a gap between the spiral wraps of both scrolls, that is, a gap in the radial direction can be prevented.

Further, the scroll-type compressor of the aforementioned configuration is provided with a pressure adding chamber (back pressure chamber) for displacing the fixed scroll toward the revolving scroll on the back side of the fixed scroll or the top plate, so that the formation of a gap between the tip end of the spiral wrap and the end plate of the mating scroll can be prevented in addition to the aforementioned effect.

We claim:

1. A scroll-type compressor which has paired fixed scroll and revolving scroll, each of which consists of a spiral wrap and an end plate, and is constructed so that said fixed scroll is fixed by a flange portion of the end plate thereof, wherein a portion of the end plate of the fixed scroll which allows elastic deformation of the end plate in a thrust direction is provided at the flange portion of the end plate of said fixed scroll.

2. A scroll-type compressor according to claim 1, wherein a pressure adding chamber for displacing said fixed scroll toward said revolving scroll is provided on a back side of said fixed scroll or in a top plate,

3. The scroll-type compressor according to claim 1, wherein said portion of the end plate of the fixed scroll which allows elastic deformation comprises annular grooves formed on opposite surfaces of the flange portion of said end plate.

4. A scroll-type compressor which has paired fixed scroll and revolving scroll, each of which consists of a spiral wrap and an end plate, and is constructed so that said fixed scroll is fixed to a top plate, wherein a portion of the top plate which allows elastic deformation of said top plate in a thrust direction is provided at the peripheral portion of said top plate.

5. A scroll-type compressor according to claim 4 wherein a pressure adding chamber for displacing said fixed scroll toward said revolving scroll is provided on a back side of said fixed scroll or in said top plate.

6. The scroll-type compressor according to claim 4, wherein said portion of the top plate which allows elastic deformation of said top plate comprises annular grooves provided alternately on the opposite surfaces of the top plate.

* * * * *